US009594352B2

(12) United States Patent
McGrane

(10) Patent No.: US 9,594,352 B2
(45) Date of Patent: Mar. 14, 2017

(54) MINUTE COUNTDOWN CLOCK

(71) Applicant: Kevin McGrane, Coram, NY (US)

(72) Inventor: Kevin McGrane, Coram, NY (US)

( * ) Notice: Subject to any disclaimer, the term of this patent is extended or adjusted under 35 U.S.C. 154(b) by 0 days.

(21) Appl. No.: 14/074,876

(22) Filed: Nov. 8, 2013

(65) Prior Publication Data

US 2015/0023139 A1 Jan. 22, 2015

Related U.S. Application Data

(60) Provisional application No. 61/846,861, filed on Jul. 16, 2013.

(51) Int. Cl.

| | |
|---|---|
| ***G04F 1/00*** | (2006.01) |
| ***G04B 19/06*** | (2006.01) |
| ***G04B 19/08*** | (2006.01) |
| ***G04F 3/00*** | (2006.01) |

(52) U.S. Cl.

CPC ..... *G04F 1/005* (2013.01); *G04B 19/06* (2013.01); *G04B 19/08* (2013.01); *G04B 19/085* (2013.01); *G04F 1/00* (2013.01); *G04F 3/00* (2013.01)

(58) Field of Classification Search

CPC ..... G04F 3/00; G04F 3/02; G04F 3/06; G04F 1/00; G04F 1/005; G04B 19/06; G04B 19/08; G04B 19/085

USPC ..... 368/80, 82, 239, 223, 228, 232

See application file for complete search history.

(56) References Cited

U.S. PATENT DOCUMENTS

| | | | | |
|---|---|---|---|---|
| 1,153,492 | A * | 9/1915 | Hoitinga | 368/16 |
| 2,169,099 | A * | 8/1939 | Ketterson | 368/80 |
| 2,518,664 | A * | 8/1950 | Chern | 434/106 |
| 4,142,306 | A * | 3/1979 | Whitlock | 434/284 |
| 4,175,378 | A * | 11/1979 | Shelton | 346/20 |
| 4,208,870 | A | 6/1980 | Cullom | |
| 4,337,530 | A * | 6/1982 | Toft, Jr. | 368/62 |
| 4,579,460 | A * | 4/1986 | Shannon | 368/27 |
| 5,044,961 | A | 9/1991 | Bruskewitz | |
| 6,146,216 | A | 11/2000 | Timsit | |
| 6,579,004 | B1 * | 6/2003 | Kim | 368/295 |
| 6,714,485 | B2 * | 3/2004 | Albisetti et al. | 368/27 |

(Continued)

OTHER PUBLICATIONS

Situations:"Bik Van der Pol, 1440 Minutes Toward the Development of a Site / 2009"; Apr. 8, 2009. Retireved from the Internet Dec. 13, 2014, URL: http://www.situations.org.uk/projects/bik-van-der-pol-1440-minutes-towards-development-site-2009/.*

(Continued)

*Primary Examiner* — Vit W Miska

(57) ABSTRACT

An improved minute countdown clock is provided that depicts the 24-hour day in terms of the number of remaining minutes, rather than in the standard 12-hour cycle. The present clock counts down the number of minutes that are left in the day, unlike a standard clock that depicts the amount of time that has passed in two separate cycles. The present invention may come in either analog or digital varieties. The present invention breaks time into smaller increments in order to reprogram individuals' concept and perception of passing time, to facilitate motivation to accomplish more goals, and finally to create a sense of value and ownership of personal time. Furthermore, the constant countdown creates a sense of urgency by helping people recognize that time is valuable and is lost once it passes.

3 Claims, 4 Drawing Sheets

(56) References Cited

U.S. PATENT DOCUMENTS

| | | | | |
|---|---|---|---|---|
| 6,809,993 | B1 * | 10/2004 | Muller | G04G 99/00 368/238 |
| 7,414,923 | B2 | 8/2008 | Kadokura | |
| D665,291 | S * | 8/2012 | Behling | D10/126 |
| 8,355,296 | B2 | 1/2013 | Endrasik | |
| 8,842,499 | B2 * | 9/2014 | Jones | 368/28 |
| 2003/0076746 | A1 * | 4/2003 | Palmer | 368/80 |
| 2006/0209637 | A1 * | 9/2006 | May | G04C 9/00 368/223 |
| 2007/0160968 | A1 | 7/2007 | Shachrur | |
| 2013/0052627 | A1 * | 2/2013 | Tzeng | 434/304 |

OTHER PUBLICATIONS

"Bik Van der Pol, 1440 Minutes Toward the Development of a Site—A Critical Response" , May 21, 2010. Retrieved from the internet Dec. 12, 2014. URL: http://onedaysculpture.org.nz/assets/images/reading/bik%20van%20der%20pol.pdf.*

"Honey Tree Project Pokemon Wiki", Nov. 27, 2010. Retrieved from the Internet Dec. 12, 2014. URL: http://projectpokemon.org/PPwiki/index.php?title=Honey_Tree&printable=yes.*

"Atlas V: Countdown 101", Dec. 5, 2010. Retrieved from the Internet. URL: http://mobile.nasa.gov/mission_pages/launch/atlas_V_count_101.html.*

* cited by examiner

MINUTE COUNTDOWN CLOCK

CROSS REFERENCE TO RELATED APPLICATION

This application claims the benefit of U.S. Provisional Application No. 61/846,861 filed on Jul. 16, 2013, entitled "1440 Clock." The above identified patent application is herein incorporated by reference in its entirety to provide continuity of disclosure.

BACKGROUND OF THE INVENTION

Field of the Invention

The present invention relates to analog and digital clocks. More specifically, the present invention relates to analog or digital countdown clocks or clock-like devices that have various mechanics to help individuals' time management skills.

Many people have difficulty planning their schedules on a daily basis. This is partly caused by the fact that the current mechanical standard 12-hour clock is archaic and devalues accountability and ownership of time. The 12-hour clock has conditioned people to think of time in terms of a relatively small number of discrete intervals. This is not conducive to today's society, which is fast-paced and requires more and more of individuals on a daily basis. People are always postponing or failing to complete tasks because they believe that there is not enough time left to complete those tasks, since time is traditionally organized in such large intervals. When an individual only has one hour left to complete a task, they often feel as though that is only enough time to complete that one task, regardless of how long it actually takes, because they only have one unit of time to perform it in. In reality, that individual has sixty units of time, i.e. minutes, and an individual could squeeze value out of all sixty of those minutes if their brain was programmed to think that way.

Current technologies attempt to solve these problems by providing individuals with visual cues or reminders for when certain tasks need to be completed in order to get people to more efficiently use their time. However, these visual cue systems require the user to pre-plan their entire day and they are not flexible enough to easily adjust when unanticipated tasks need to be addressed or when a task takes an unanticipated length of time. It is a more efficient and complete solution to simply re-wire the way people think about time. Existing devices merely break up the day into long, discrete intervals, which the traditional clock already does by 1-hour intervals. These devices break the up the day by different intervals, but in intervals that are still too large for the given task of personal time keeping and task management. While this may be useful if an individual's day consists solely of addressing a linear list of tasks, most individuals' schedules are relatively unknown at the beginning of the day and require them to be flexible enough to address a wide range of potential tasks and issues. Furthermore, the devices in the art do not address the fundamental problem of people setting their schedules based on an archaic and outdated time model.

The present invention takes a holistic approach to improving the way users view time by depicting the day as a countdown for the number of minutes left, rather than as the traditional 12-hour clock. This setup encourages individuals to view time in a more organic fashion, rather than as a relatively small number of discrete units, because the entire day is laid out before an individual as 1,440 units instead of 24 units. When the day is only broken into 24 time units, individuals often feel that they do not have time to complete a given task or do not use all of their time efficiently, because they do not adequately account for the fractional values of the hours left and do not view time in a seamless, organic fashion. Furthermore, the fact that the present improved clock counts down from a set value, rather than systematically aggregating time, gives individuals a sense of urgency because they can recognize that time is valuable as it is constantly being lost.

Description of the Prior Art

Devices have been disclosed in the prior art that relate to aids for use in time management. These include devices that have been patented and published in patent application publications. These devices generally relate to clocks having mechanisms to assist users in visualizing when certain tasks need to be completed and how long it takes to complete said tasks. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 4,208,870 to Cullom, which discloses a visual reminder system to be used in conjunction with a standard analog clock. The visual reminder system comprises a plurality of articles representing various tasks that may be removably attached to support means on the clock. Users may indicate by what time certain tasks need to be completed by placing an appropriate article on the clock face, aligned with the associated hour or minute indicator. While this device provides a means for visualizing by when certain tasks need to be completed, it still fails to provide users with an overall understanding of the value of time. The present invention provides users with an overall understanding of exactly how much time is left in the day, rather than the time remaining until an event occurs, so that their entire day can be planned efficiently instead of just that single event.

Another such device is U.S. Pat. No. 5,044,961 to Bruskewitz, which discloses a timer for teaching children the concept of time by providing programmable tasks of a set duration. The child is able to graphically visualize the passage of time for the activity being timed. Bruskewitz only assists users in visualizing the time left for a single task. The present invention, on the other hand, provides a total visualization for the entire day in terms of the number of remaining minutes so individuals can intelligently plan all of their tasks, rather than just a single task.

U.S. Pat. No. 6,416,216 to Haughey and U.S. Pat. No. 7,414,923 to Kadokura disclose event calendars to assist individuals who have difficulty keeping track of time for tasks, such as children. For people that cannot read a clock, such as small children, a clock is an ineffective means to help them manage their schedule, so Haughey and Kadokura provide a plurality of removable, graphical event markers that may be freely rearranged and an indicator that visually represents the passage of time for that particular event. Haughey and Kadokura break an individual's day into a series of discrete events, whereas the present invention seeks to provide a user with a total picture of the time remaining in the day. Haughey and Kadokura seek to help individuals who have difficulty completing tasks on time, whereas the present invention seeks to help individuals maximize the number of tasks that they can complete in a day.

Another such device is U.S. Pat. No. 8,355,296 to Endrasik, which discloses an analog clock with a plurality of activity displays that inform the user what activity is to be performed during which time period. Like Bruskewitz, Haughey, and Kadokura, Endrasik is primarily intended to be used by children because they have difficulty keeping track of time. The present invention is not intended to be used primarily by children, but is instead useful to the population as a whole. The present improved clock breaks down the entire day into minutes, rather than hours, to give individuals a more complete concept of the time remaining in the day. Whereas a standard clock is broken down into 24 rather long time intervals, the present invention reprograms users' brains so that they do not feel limited by the relatively few number of time intervals, but instead have a complete picture of all the time that the day entails.

Finally, U.S. Published Patent Application Publication No. 2007/0160968 to Shachrur discloses an analog clock-like device that has graphical activity markers in place of the traditional hour numerals on the clock face. Like the previously discussed inventions, Shachrur is intended to help individuals manage their time by giving them graphical representations of what they should be doing at any given moment. Shachrur requires an individual to pre-plan their entire day prior to beginning their tasks, because the graphical representations of the tasks must be placed ahead of time and the individual needs to allocate the necessary amount of time between the various tasks. The present invention does not utilize graphical representations of tasks and instead takes a more holistic approach to time management by encouraging users to see all of the time available in the day and recognizing the substantial amount of available time, rather than dividing the day into a series of discrete events or large time intervals. People may otherwise not spend their time wisely and may postpone work assignments, schoolwork, or other tasks because they perceive that there is not enough time in the day.

The present invention provides an analog or digital clock with the traditional time indicators replaced by a countdown for the total number of minutes remaining in the day. Such a configuration encourages individuals to exert ownership over their time rather than being conditioned to think of time in a relatively small number of hours. The present invention is submitted as being substantially divergent in design elements from the prior art and as introducing a new means of time management. It is clear that there is a need in the art for an improvement to existing analog clock or time management devices. In this regard the instant invention substantially fulfills these needs.

SUMMARY OF THE INVENTION

In view of the foregoing disadvantages inherent in the known types of clocks and time management devices now present in the prior art, the present invention provides a new analog or digital clock wherein the same can be utilized for providing convenience for the user when seeking to maximize their daily efficiency.

It is therefore an object of the present invention to provide a new and improved minute countdown clock device that has all of the advantages of the prior art and none of the disadvantages.

It is another object of the present invention to provide a minute countdown clock device that allows individuals to schedule their days more efficiently.

Another object of the present invention is to provide a minute countdown clock device that counts down the time remaining in the day to gives individuals a sense of urgency about their day so that they value their time more.

Yet another object of the present invention is to provide a minute countdown clock device that breaks time into units more aligned with the brain's processing power.

Yet another object of the present invention is to provide a minute countdown clock device that represents an entire day in minutes, rather than hours.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
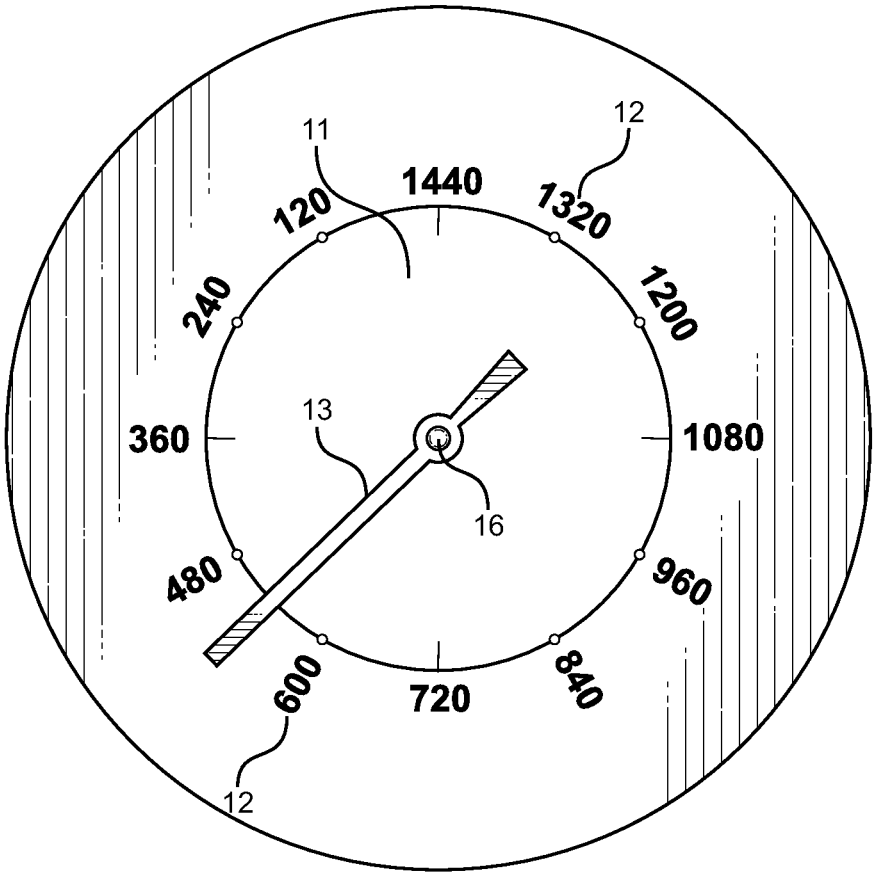
FIG. 1 shows a perspective view of an analog clock embodiment of the minute countdown clock device.

Reference is made herein to the attached drawings. Like reference numerals are used throughout the drawings to depict like or similar elements of the improved analog clock device. For the purposes of presenting a brief and clear description of the present invention, the preferred embodiment will be discussed as used for planning one's day more efficiently. The figures are intended for representative purposes only and should not be considered to be limiting in any respect.

Referring now to FIG. 1, there is shown a perspective view of an analog clock embodiment of the improved minute countdown clock device of the present invention. The present analog minute countdown clock comprises a clock face 11, a dozen minute interval marks 12, and a minute hand 13 rotating about a center point 16. The clock mechanism may be of any preferred form, such as mechanical or electrical, that is widely known and disclosed in the prior art. Although the present clock housing 11 is depicted as round, no specific claim is made as to the size, shape, or style of the present analog clock, including the design of the clock housing, the clock face, the clock crystal, or the like. The present analog minute countdown clock can be battery-operated or be powered via a connected power source.

The minute interval marks 12 of the clock face 11 are disposed along the periphery thereof, beginning at 1,440. This number represents the total number of minutes in a day. This number is decreased by 120 in a clockwise fashion around the periphery until returning to the original 1,440 marking at the top of the clock face. The day begins at 1,440, representing the number of minutes left in the day, and counts down to zero, at which point the countdown resets. The minute hand 13 rotates from a center point 16 within the clock housing 11 and makes a full revolution once every 24 hours.

The present invention can be contained within any type of clock housing, such as a standard covering with transparent plastic material or an exposed housing wherein there is no covering between the moving components of the clock face 11 and the outside. No claim is made as to the specific type of clock housing. The present invention is also not limited to merely wall-mounted clocks and may include watches and other such devices.

In embodiments of the present invention where the clock face 11 is round, the 1,440 marking of the minute indicators 12 is preferably at the top most portion of the periphery of the clock face 11 and the other markings are evenly spaced such that the 1080 and 360 markings are at the farthest sides of the periphery, and the 720 marking is at the farthest bottom point of the periphery. In alternative embodiments of the present invention, the clock face 11 can be shapes other than round, which affects the distribution of the minute indicators 12. For example, for analog clock embodiments of the present invention having a square clock face 11, the minute indicators 12 may be disposed such that there are three per side of the square. Other embodiments having a clock face 11 with different shapes and different distributions of minute indicators 12 are also possible and no specific claim is made to the shape of the clock face 11 or the distribution of the minute indicators 12.

The 1,440 minute indicator 12 marking corresponds to 12 AM on a traditional clock and the present analog countdown clock counts down therefrom in 120-minute intervals, meaning that the 1080 marking corresponds to 6 AM, 720 corresponds to 12 PM, and 360 corresponds to 6 PM. The minute hand 13 is rotated smoothly around the center point 16 of the clock face 11 such that at each 120-minute interval the minute hand 13 is directly aligned with the corresponding minute indicator 12.

Figure 2:
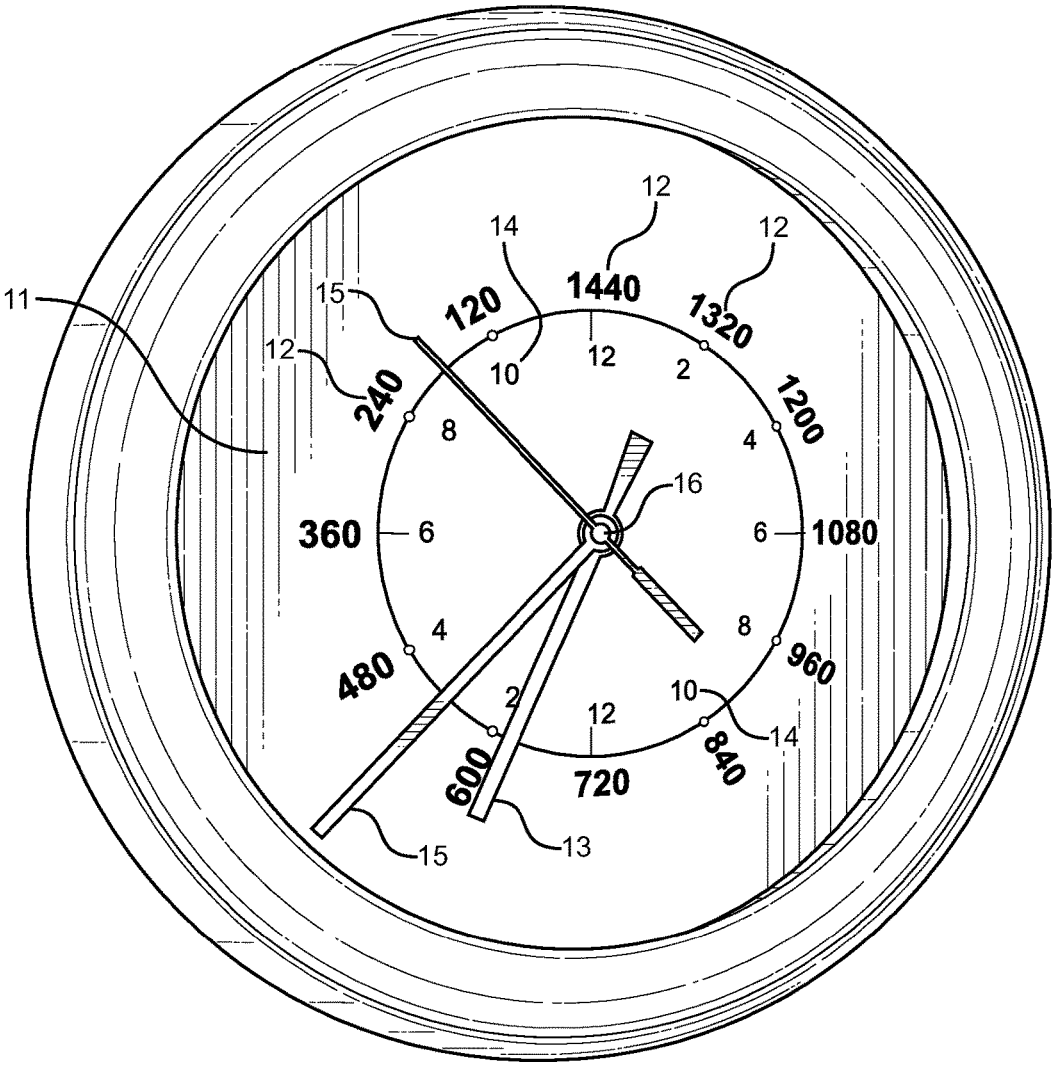
FIG. 2 shows a perspective view of an alternate analog clock embodiment of the present minute countdown clock device additionally having the traditional hour indicators.

Referring now to FIG. 2, there is shown a perspective view of an alternate analog clock embodiment of the present invention wherein the clock face additionally has the traditional hour indicators and clock hands. Optionally, the traditional hour marks 14 may also be disposed along the interior periphery of the clock face 11, along with a first and a second traditional clock hand 15 for indicating the minutes within an hour, rather than the total number of minutes left in the day that is already displayed, and the seconds within a minute. The hour marks 14 are disposed in 2-hour intervals aligned with the 120-minute intervals disclosed above. This allows the clock to function dually as both a traditional 24-hour analog clock and the present 1,440 minute-based countdown clock.

Figure 3:
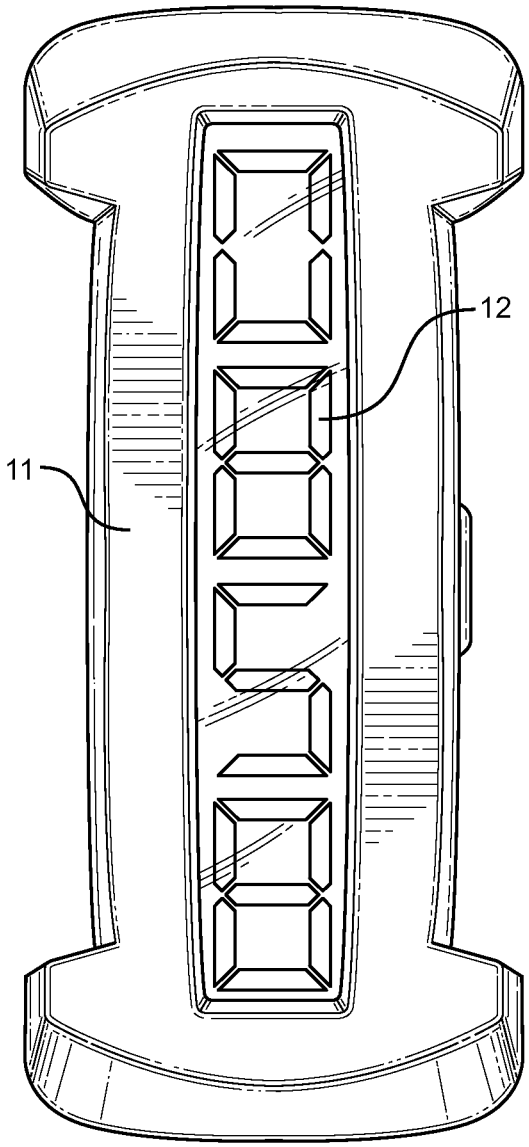
FIG. 3 shows a perspective view of a digital clock embodiment of the present minute countdown clock device.

Referring now to FIG. 3, there is shown a digital clock embodiment of the present minute countdown clock device. The digital clock embodiments operate in fundamentally the same manner as the analog clock embodiments. The minute indicators 12 countdown from 1,440 until the clock resets at 1,440 at the end of a 24-hour period. Each decrement as the digital clock counts down is equal to one minute of time. Just as with the analog embodiment of the present invention, 1,440 corresponds to 12 AM on a standard clock. 1,440 represents the number of minutes remaining at the day, starting from the beginning of the day at midnight.

The digital clock embodiment of the present invention is depicted in an upright, vertical configuration with protruding horizontal upper and lower portions, but no claim is made as to the exact configuration of the housing of the digital clock. The depicted digital clock embodiment of the present invention is intended to solely be exemplary and the claims should not be read to be limiting in any respect as to the design of the digital clock housing. The digital clock embodiment of the present invention may further include aspects of traditional digital clocks, such as alarm settings.

Figure 4:
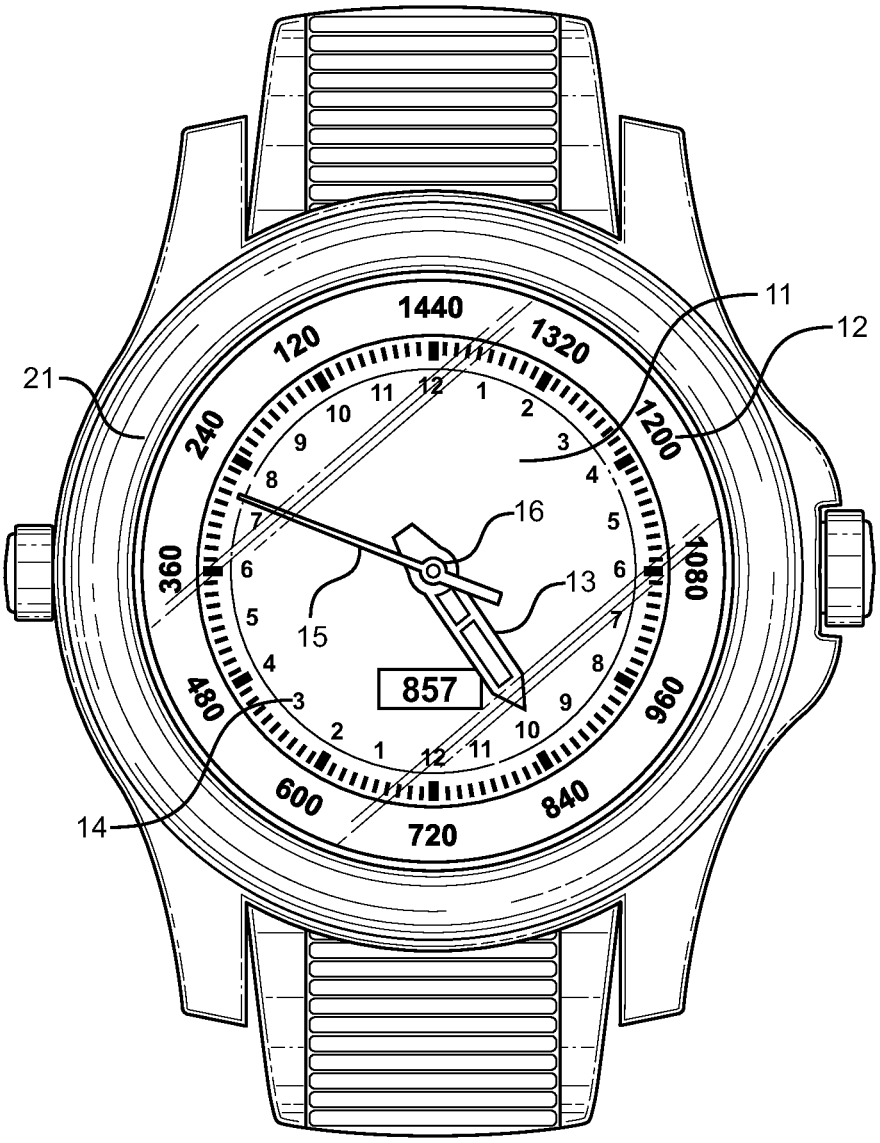
FIG. 4 shows a perspective view of an embodiment of the present minute countdown clock device as a watch.

Referring now to FIG. 4, there is shown a perspective view of an analog clock embodiment of the present invention as a wristwatch. The analog and digital clock embodiments of the present minute countdown clock invention are not limited to merely wall-mounted or free-standing clocks. The analog and digital clock embodiments may further include wristwatches, or any other type of time keeping device.

The depicted embodiment of the wristwatch analog clock embodiment of the present invention includes all of the components of the analog countdown minute clock as discussed above. The wristwatch 21 includes a clock face 11 with a minute indicator 13 rotating about a center point 16. A plurality of minute indicators 13 are disposed along the periphery of the clock face 11. The minute indicators 13, representing the number of minutes left in the given day, count down from 1,440 until the clock resets. The traditional hour indicators 14 may further be disposed along the periphery of the clock face 11. A traditional clock hand 15 or hands may additionally rotate around the center point 16 in order to indicate either the number of seconds passing within the given minute or the number of minutes passing within the given hour. No claim is made as to the specific type, style, configuration, or orientation of the wristwatch; the claims are specifically directed only to the minute countdown characteristics of the clock face. The wristwatch may further include digital, in addition to analog, embodiments of the present invention.

There are several benefits to using the analog clock of the present invention in lieu of a standard 12-hour analog clock. The primary benefit of the present analog clock is that it more closely aligns with the speed at which modern individuals process information. With the vast array of information available to the general population, people can now complete tasks in minutes instead of hours or days. However, the traditional clock has not changed to recognize this shift. It is inefficient for individuals to be planning their tasks based around a time system built on hours, when tasks rarely take that long. Such a system leads to wasted time that could be used more efficiently.

A second benefit of the present analog clock is that it imparts a sense of value to time that individuals may not necessarily recognize when using a traditional analog clock. Whereas traditional analog clocks aggregate time and display it as steadily increasing throughout the day, the present analog clock counts down from the total number of minutes available each day. This countdown creates a sense of urgency in individuals' minds that causes them to more accurately value time, because it serves as a visceral reminder that one must value time highly since once it is gone, it is lost forever. Therefore, it is a precious commodity that must be recognized as such.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An analog countdown clock, comprising:

a clock face having a center point;

at least twelve minute indicators disposed along a periphery of the clock face, the indicators comprising numerals decreasing in equal increments of 120 from 1440 to 0;

a minute hand rotating around said center point of said clock housing;

means for rotating the hand one complete revolution in 24 hours.

2. The analog countdown clock of claim 1, further comprising:

a plurality of hour indicators disposed along the periphery of said clock housing;

a first hand rotating around said center point of said clock housing, wherein one complete revolution is equal to one hour;

a second hand rotating around said center point of said clock housing, wherein one complete revolution is equal to one minute.

3. The analog countdown clock of claim 2, comprising twelve said hour indicators.

* * * * *